US008904569B2

(12) United States Patent
Dumouchelle

(10) Patent No.: US 8,904,569 B2
(45) Date of Patent: Dec. 9, 2014

(54) APPARATUS FOR DISTRIBUTING PRESSURE FROM A STRAP

(75) Inventor: Joanne Melody Dumouchelle, Windsor (CA)

(73) Assignee: Joanne Melody Dumouchelle, Windsor, Ontario (CA)

( * ) Notice: Subject to any disclaimer, the term of this patent is extended or adjusted under 35 U.S.C. 154(b) by 106 days.

(21) Appl. No.: 13/428,752

(22) Filed: Mar. 23, 2012

(65) Prior Publication Data

US 2012/0240313 A1 Sep. 27, 2012

Related U.S. Application Data

(60) Provisional application No. 61/467,054, filed on Mar. 24, 2011.

(51) Int. Cl.
*A41D 27/26* (2006.01)
*A41F 15/00* (2006.01)

(52) U.S. Cl.
CPC ..... *A41F 15/007* (2013.01)
USPC ..... 2/460; 224/264; 297/488

(58) Field of Classification Search
USPC ..... 24/712, 713, 715.4, 713.1, 712.2, 910, 24/712.1; 2/460, 459, 245, 268, 341, 338, 2/461; 297/488; 224/264
See application file for complete search history.

(56) References Cited

U.S. PATENT DOCUMENTS

| | | | | |
|---|---|---|---|---|
| 1,166,629 | A * | 1/1916 | Pratt | 63/3 |
| 1,531,410 | A * | 3/1925 | Osterholt | 24/712.1 |
| 2,808,973 | A * | 10/1957 | Gobble | 224/264 |
| 4,553,293 | A * | 11/1985 | Blum | 24/712.2 |
| 5,027,482 | A * | 7/1991 | Torppey | 36/50.1 |
| 5,168,576 | A * | 12/1992 | Krent et al. | 2/456 |
| 6,698,030 | B2 * | 3/2004 | Cutler | 2/267 |

* cited by examiner

*Primary Examiner* — Jack W Lavinder
(74) *Attorney, Agent, or Firm* — Perry + Currier, Inc.

(57) ABSTRACT

An apparatus and method for distributing pressure from at least one strap are provided. The apparatus includes a first surface for resting against a wearer, a second surface opposite to the first surface, and a securing mechanism. The method involves resting an area of the first surface against the wearer, supporting a strap over a second area on the second surface and securing the strap over the second area.

3 Claims, 23 Drawing Sheets

APPARATUS FOR DISTRIBUTING PRESSURE FROM A STRAP

CROSS-REFERENCE TO RELATED APPLICATION

This application claims priority from U.S. Provisional Patent Application 61/467,054, filed Mar. 24, 2011, the content all of which is incorporated herein by reference.

FIELD

The specification generally relates to an apparatus for distributing pressure from a strap and specifically to an apparatus for distributing pressure from a strap of a garment.

BACKGROUND

When a garment is positioned on a wearer by straps, such as a halter top and a bikini bottom, a knot formed by fastening straps together (as well as the straps) can produce pressure on the region of the wearer supporting the straps. The pressure can cause discomfort or injury. This problem can also arise when wearing a garment (such as bras) that uses straps without forming a knot. The knot, or straps, or both can also exacerbate a pre-existing wound such as a surgical wound from vertebra surgery.

SUMMARY

In accordance with an aspect of the invention, there is provided apparatus for distributing pressure from at least one strap. The apparatus includes a first surface have a first area for resting against a wearer. Furthermore, the apparatus includes a second surface opposite the first surface. The second surface is for supporting the at least one strap of the garment over a second area. The first area is larger than the second area such that a first pressure applied by the first surface on the wearer is less than a second pressure applied by the at least one strap on the second surface. In addition, the apparatus includes a securing mechanism for securing the at least one strap over the second area.

The securing mechanism may include a strap aperture configured to receive the at least one strap therethrough.

The securing mechanism may include a divot for receiving a knot to position the knot over the divot.

The securing mechanism may include a knot aperture for receiving a knot therein to position the knot within the knot aperture.

The securing mechanism may include a knot aperture for receiving a knot therein to position the knot within the knot aperture.

The securing mechanism may include a channel for guiding the at least one strap over the second area.

The securing mechanism may include a first strap aperture and a second strap aperture.

The first strap aperture may be configured to receive a first strap therethrough and the second strap aperture may be configured to receive a second strap therethrough.

The securing mechanism may include a channel extending between the first strap aperture and the second strap aperture. The channel may be for guiding the first strap and the second strap over the second area.

The securing mechanism may include a knot aperture for receiving a knot therein to position the knot within the knot aperture.

The securing mechanism may include a first channel extending between the first strap aperture and the knot aperture. The securing mechanism may also include a second channel extending between the second strap aperture and the knot aperture. The first channel is for guiding the first strap and the second channel is for guiding the second strap.

In accordance with an aspect of the invention, there is provided a method for distributing pressure from at least one strap. The method involves resting a first area of a first surface against a wearer. The method further involves supporting the at least one strap of the garment over a second area of a second surface. The second surface is opposite the first surface. The first area is larger than the second area such that a first pressure applied by the first surface on the wearer is less than a second pressure applied by the at least one strap on the second surface. The method also involves securing the at least one strap over the second area.

Securing may involve passing the at least one strap through a strap aperture.

Securing may involve positioning a knot within a knot aperture.

Securing may involve guiding the at least one strap in a channel over the second area.

Securing may involve passing a first strap through a first strap aperture and passing a second strap through a second strap aperture.

Securing may involve guiding the first strap and the second strap through a channel extending between the first strap aperture and the second strap aperture.

The method may further involve tying a knot between the first strap and the second strap.

Securing may involve positioning the knot within a knot aperture.

Securing may involve guiding the first strap and through a first channel extending between the first strap aperture and the knot aperture. Securing may further involve guiding the second strap and through a second channel extending between the second strap aperture and the knot aperture.

An aspect of the specification provides an apparatus for distributing pressure from at least one strap of a garment, comprising: a substantially planar member comprising a pressure bearing side and a pressure distribution side; and at least one aperture defined by the substantially planar member, the at least one aperture for threading the at least one strap there through, such that the at least one strap runs across the pressure bearing side, and the pressure from the at least one strap is distributed across the pressure distribution side.

The at least one aperture can comprise two apertures distal from one another such that the at least one strap is threaded there between.

The substantially planar member can comprise a recess disposed between the two apertures, the recess for receiving a knot in the at least one strap.

The substantially planar member can further comprise at least one channel disposed the between two apertures, the at least one channel for receiving the at least one strap.

The recess can comprise a divot.

The recess can comprise an opening in the substantially planar member.

The distance between the two apertures can range from approximately 2 inches to approximately 4 inches.

BRIEF DESCRIPTIONS OF THE DRAWINGS

In drawings which illustrate embodiments of the invention,

DETAILED DESCRIPTION

Figure 1:
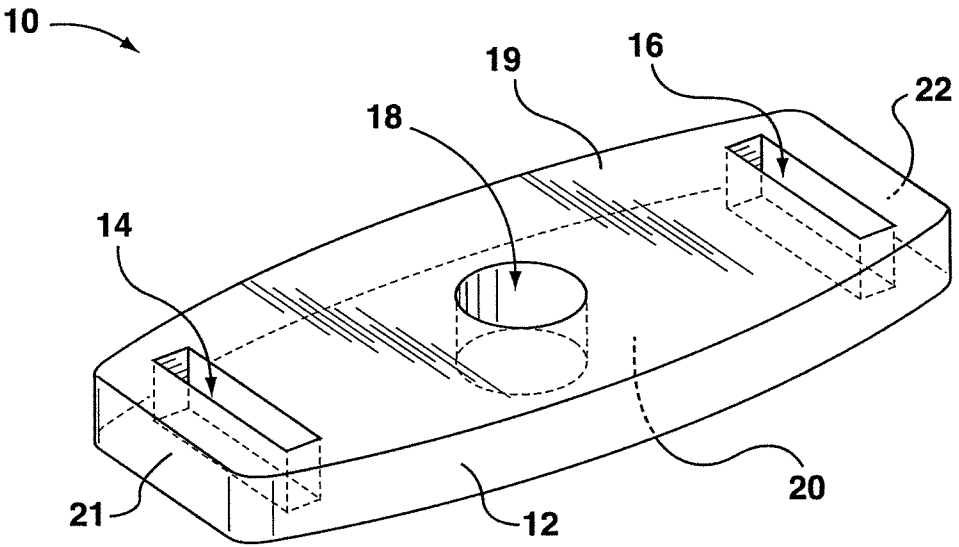
FIG. 1 is an isometric view of an apparatus according to an embodiment.
Figure 2:
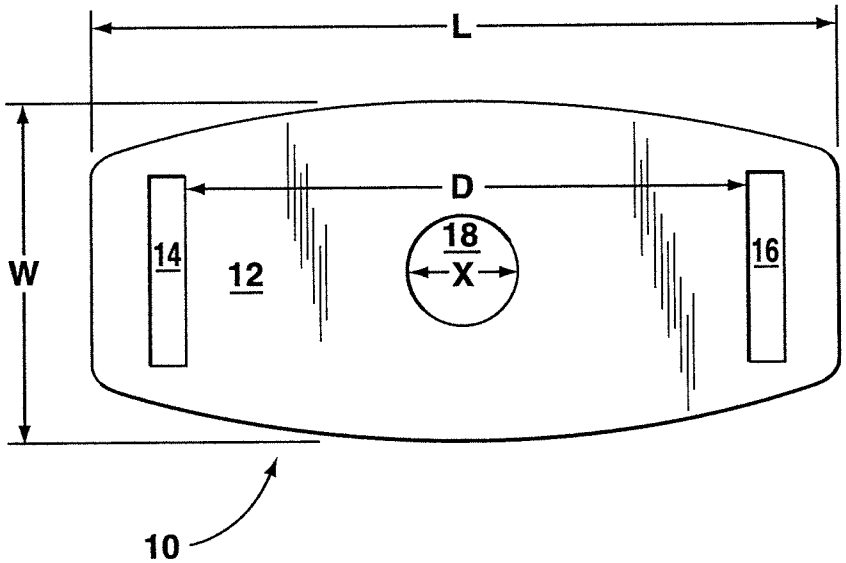
FIG. 2 is a top view of the embodiment shown in FIG. 1.
Figure 3:
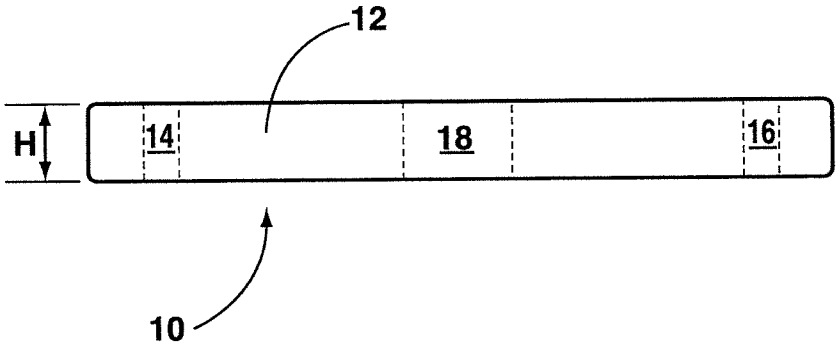
FIG. 3 is a side view of the embodiment shown in FIG. 1.

Referring to FIGS. 1-3, an apparatus for distributing pressure from a garment is shown generally at 10. It is to be understood that the apparatus 10 shown is purely exemplary and a variety of different apparatus for distributing pressure from a garment are contemplated. The apparatus 10 includes a first surface 20, a second surface 19, and a securing mechanism. In the present embodiment, the securing mechanism includes a first strap aperture 14, a second strap aperture 16 and a knot aperture 18.

In general terms, the first surface 20 is generally configured for resting against a wearer. Therefore, an area of at least a portion of the first surface 20 is in contact with the wearer. It is to be understood that the term resting is not particularly limited and does not require direct contact between the first surface 20 and the skin of the wearer. For example, although an area of the first surface 20 can rest against the skin of the wearer, the area may also rest over another piece of clothing or other covering on the skin such as a bandage. It is to be understood that the first surface 20 is not particularly limited to any material and that several different types of materials are contemplated for the first surface. The first surface 20 is typically constructed from materials which are suitable for use in clothing and accessories. In particular, the first surface 20 is preferably lightweight for greater comfort when resting against the skin of a wearer. Some examples of suitable materials include plastics, foam, leather, fabrics and other materials commonly used in clothing and accessories.

The second surface 19 is generally configured for supporting a strap. In general, the strap is a strap of a garment worn by the wearer. However, in some embodiments, the strap can be from other articles, such as a bag or other apparatus for carrying an item. It is to be understood that the strap is generally supported over an area of the second surface 19. In general, the area of the second surface 19 over which the strap is supported is smaller than the area of the first surface 20 in contact with the wearer. Therefore it is to be appreciated, with the benefit of this specification, that the force applied by the strap over the area of the second surface 19 will be distributed over the area of the first surface 20 to reduce the pressure applied on the wearer.

In the present embodiment, the first surface 20 and the second surface 19 are opposite surfaces of a substantially planar member 12. It is to be understood that the substantially planar member 12 is not particularly limited to any material and that several different types of materials are contemplated. The substantially planar member 12 is typically constructed from materials which are suitable for use in clothing and accessories. In particular, the substantially planar member 12 is preferably lightweight for comfort and as well as sufficiently durable. Some examples of suitable materials include plastics, foam, leather, fabrics, rubber, neoprene and other materials commonly used in clothing and accessories. The exact shape of the substantially planar member 12 is also not particularly limited. In the present embodiment shown in FIGS. 1-3, the substantially planar member 12 is shaped as a planar elongated member. In other embodiments, the substantially planar member 12 can be modified to be curved instead of planar to match the contours of the wearer. Also, in other embodiments the substantially planar member 12 can be modified to be circular or any other shape.

The securing mechanism is generally configured to secure a strap over an area of the second surface. In the present embodiment, the securing mechanism includes a first strap aperture 14, a second strap aperture 16 and a knot aperture 18. The first strap aperture 14 and the second strap aperture 16 form a passage through the apparatus 10 and are each configured to allow a strap to pass therethrough. It is to be understood that the same strap can pass through both the first strap aperture 14 and the second strap aperture 16. The strap is secured over an area extending substantially between the first strap aperture 14 and the second strap aperture 16 by the tension of the strap and by the first aperture and the second aperture inhibiting lateral movement along the second surface 19. Alternatively, separate strap ends can pass through each aperture and be connected such the strap ends are secured over the area extending substantially between the first strap aperture 14 and the second strap aperture 16. In other embodiments, more than one strap can pass through each of the first strap aperture 14 and the second strap aperture 16.

The knot aperture 18 forms a passage through the apparatus 10 and is generally configured to receive at least a portion of a knot therein. In particular, the knot aperture 18 is generally configured to guide a knot to a position where at least a portion of the knot is within the knot aperture 18. Therefore, the knot aperture 18 further secures the strap over the area by inhibiting lateral movement along the second surface 19 since the knot is urged into the knot aperture by tension. The type of knot used is not particularly limited. For example, when the same strap passes through both the first strap aperture 14 and the second strap aperture 16, the knot can be an overhand knot, a figure-eight knot as well as any other knot that can be tied with a single strap. Alternatively, when separate strap ends pass through each of the first strap aperture 14 and the second strap aperture 16, the strap ends can be fastened with a knot such as square knot, granny knot, granny bow, or any other knot for connecting two straps ends. It is to be appreciated that, in some further embodiments, the separate strap ends can be opposite ends of the same strap or ends of two different straps.

It is to be understood that the securing mechanism is not particularly limited and that several different types of securing mechanisms are contemplated. For example, instead of using a first strap aperture 14 and a second strap aperture 16, the securing mechanism can include a clip, a loop, an adhesive area, hook and loop fasteners, or any other securing mechanism configured to secure a strap over an area of the second surface 19. Indeed, different securing mechanisms are contemplated herein.

In use, the apparatus 10 is configured for distributing pressure from at least one strap. It is to be appreciated that a strap of a garment applies different pressures along the strap against a body of a wearer. Therefore, the apparatus 10 is generally configured to be used at positions along the strap where the pressure is sufficiently high to cause discomfort to the wearer.

In use, the apparatus 10 can alleviate discomfort or injury caused by a strap of a garment pressing against a wearer or by a knot fastened from least two straps of a garment pressing against the wearer. Additionally, discomfort or injury caused by a knot formed on a single strap can also be alleviated. The apparatus 10 is configured to distribute the pressure from the straps across a region of the wearer that is in contact with an area of the first surface 20 of the apparatus 10.

As discussed above, the apparatus 10 includes a substantially planar member 12 defining a first strap aperture 14, a second strap aperture 16. As shown in FIGS. 1-3, the second strap aperture 16 is distal from the first strap aperture 14. Furthermore, the substantially planar member 12 further defines a knot aperture 18 disposed between the first strap aperture 14 and the second strap aperture 16. The substantially planar member 12 comprises a pressure bearing side, which in this embodiment includes at least a portion of the second surface 19, and a pressure distribution side, which in this embodiment includes at least a portion of the second surface 20. It is to be understood that, depending on use, the knot aperture 18 can be modified to be a recess or can be omitted entirely. For example, in embodiments where a knot is absent from the strap, the knot aperture can be omitted. In the present embodiment, the knot aperture 18 extends through the apparatus 10. When the apparatus 10 is used to prevent the strap or a knot or both of a garment from irritating an injury, the knot aperture 18 can be used to confine the injury within the space defined by the knot aperture.

Referring again to the embodiment shown in FIGS. 1-3, the substantially planar member 12 is formed from various materials which can include foam, rubber, or neoprene and can be generally elliptical with the ends along the major axis truncated to form substantially straight edges 21, 22. However, it is to be understood that the substantially planar member 12 is not particularly limited to this shape and can be any suitable shape and can be formed from any other suitable material. For example, in other embodiments, suitable shapes can be aesthetically appealing shapes in accordance with fashion trends, which includes, but is not limited to, shapes resembling various flowers. In the present embodiment, the first strap aperture 14 and the second strap aperture 16 are substantially rectangular and are substantially similar in shape and size. However, it is to be understood that the first strap aperture 14 and the second strap aperture 16 can be modified to be of any suitable shape (e.g., oval, circular, triangular, etc. . . . ) and any suitable size. Furthermore, it is to be appreciated that the shape and size of the first strap aperture 14 need not be similar to the shape and size of the second strap aperture 16.

Referring to FIGS. 2 and 3, the substantially planar member 12 has a length L, a width W, and a height H in the present embodiment. It is to be appreciated that the length L, the width W, and the height H can be determined depending on the application of the apparatus 10. For example, in applications where the apparatus 10 is configured to be used for halter tops, the length L can be about 4.625 inches, the width W can be about 2.1875 inches, and the height about 0.5 inches.

The distance D (see FIG. 2) is the distance between the first strap aperture 14 and the second strap aperture 16. The distance D can depend on factors such as the physical dimensions of the wearer and the application of the apparatus 10. For example, when the apparatus is configured to be worn by a female wearer of average physical size for the application, the distance D is be about 2 to about 4 inches. However, it is to be appreciated that the distance D can be any suitable length, and that the apparatus 10 can be provided in a variety of sizes (e.g. small, medium, large, extra large, or the like) suitable for wearers of any given size and/or dimension. In other embodiments, it can be desirable to shorten the distance D so that the apparatus is more inconspicuous.

In the present embodiment, the diameter X of the knot aperture 18 is about 0.5 inch to about 1 inch. However, it is to be appreciated that the diameter X can be modified to be any suitable length that would not interfere with the natural movement of the wearer's head such as nodding. In other embodiments where the apparatus 10 is not worn around the back of the neck area of the wearer, the movement of the head of the wearer would be less relevant for determining diameter X.

Any suitable method can be used to manufacture the apparatus 10. For example, the first strap aperture 14, the second strap aperture 16, and the knot aperture 18 can be formed by removing material from a sheet of foam (not shown) followed by extracting a substantially planar member 12 from the sheet of foam. In another embodiment, the apparatus 10 can be cut or extracted from a sheet of foam with a stamp or dye configured to remove the material to form the first strap aperture 14, the second strap aperture 16, and the knot aperture 18 and to extract the substantially planar member 12 from the sheet of foam in one step. In yet another embodiment, the apparatus 10 can be formed from a moulding process.

Figure 4:
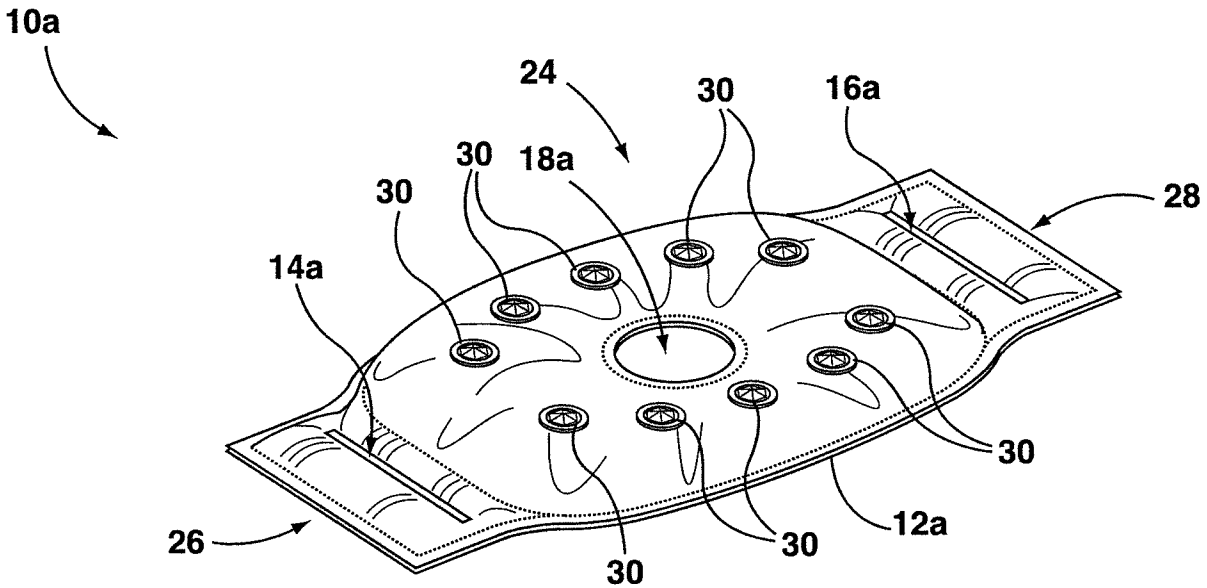
FIG. 4 is an isometric view of an apparatus according to another embodiment.
Figure 5:
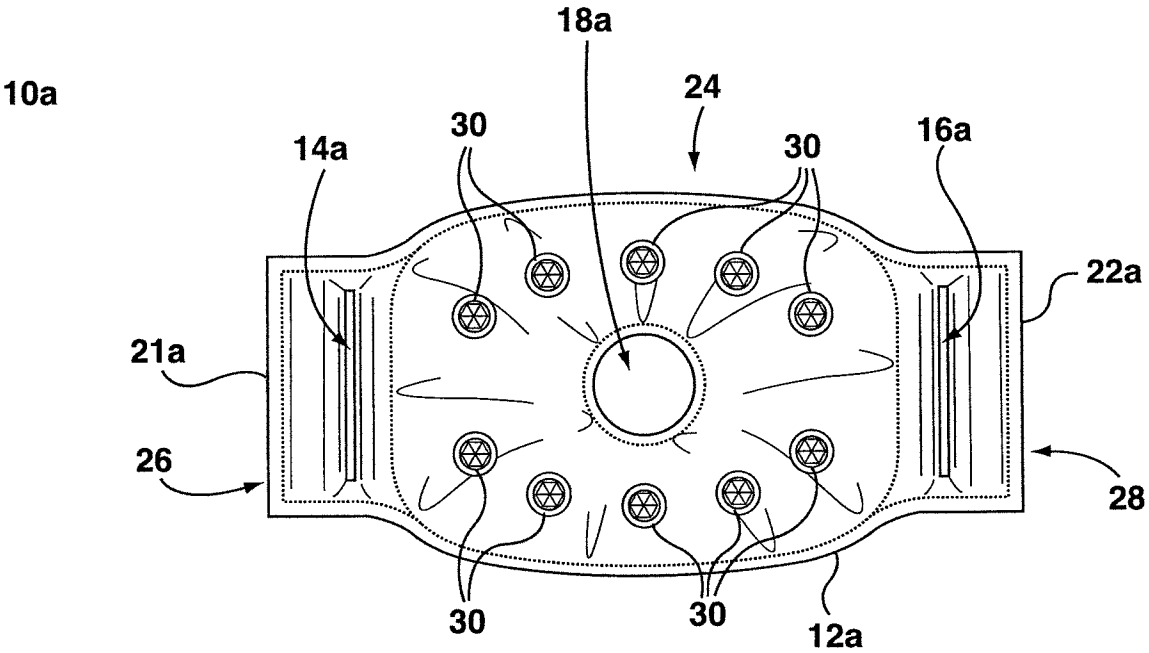
FIG. 5 is a top view of the embodiment shown in FIG. 4.

Referring to FIGS. 4 and 5, an alternative embodiment of the apparatus 10 is shown generally at **10*a*. Like reference numerals will be used to designate similar structures of the apparatus 10, but with a suffix "a" appended thereto. The apparatus 10*a* includes a substantially planar member 12*a* having a securing mechanism. In the present embodiment, the securing mechanism includes a first strap aperture 14*a*, a second strap aperture 16*a* and a knot aperture 18*a***.

In the present embodiment, the substantially planar member **12*a* comprises a mid-portion 24, a first wing 26, a second wing 28, and at least one decorative member 30. Examples of decorative members include gem, sequins and other things commonly used to decorate accessories or clothing. The location of the decorative member 30 is not particularly limited and can be positioned anywhere on the apparatus 10*a* for decorative purposes. The substantially planar member 12*a* is made from two similarly shaped sheets of fabric sewn together to encase a filler material in the mid-portion 24. The filler material to increases the support for a knot received and supported by the knot aperture 18***a*. It is to be understood that the shape of the apparatus 10*a* is exemplary and that any suitable shape can be used.

Figure 6:
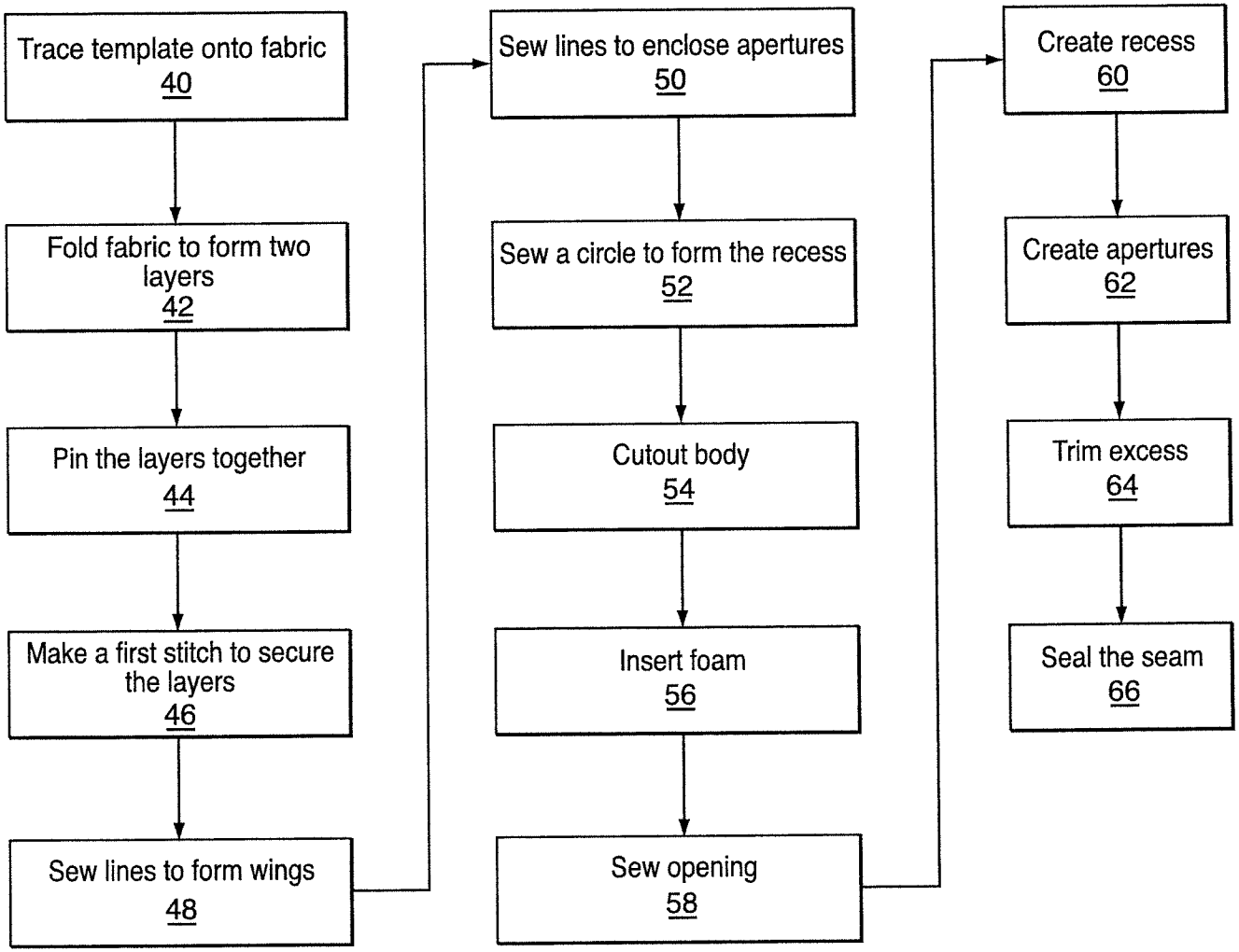
FIG. 6 is block diagram of a method according to an embodiment for creating the embodiment shown in FIG. 4.

FIG. 6 illustrates a method of manufacturing the apparatus 10*a*. It is to be appreciated that the method shown in FIG. 6 need not be performed in the exact sequence as shown, hence the elements of the method are referred to herein as "blocks" rather than "steps". For example, the order of some blocks can be interchanged. In addition, some of the blocks may also be performed in parallel.

Block 40 comprises tracing a template of the apparatus 10*a* onto a fabric. In the present embodiment, the fabric can comprise bridal satin. However, it is to be understood that any other suitable fabric can be used, including but not limited to satin, cotton, silk, polyester and the like.

Block 42 comprises folding the fabric to create two layers of fabric. For example, after tracing a template onto a fabric, a portion of the fabric can be folded under the template to form two layers of fabric. It is to be understood that rather than folding the fabric, the process can start with two sheets of fabric or another sheet of fabric can be inserted under the sheet of fabric after tracing the template onto the latter sheet of fabric.

Figure 7:
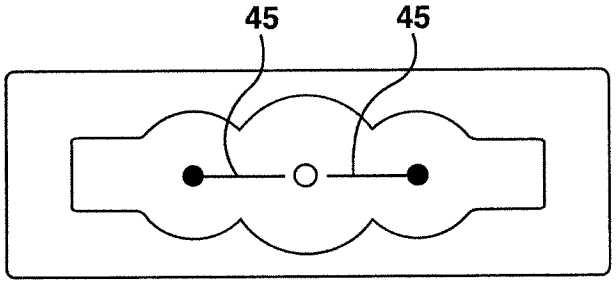
FIG. 7 is a top view of the apparatus of FIG. 4 during the performance of a block of FIG. 6.

Block 44 comprises pinning the two layers of fabric together. For example, straight pins 45 can be used to hold the two layers of fabric together. The pins 45 can be placed near the center of the apparatus 10*a* as shown by FIG. 7.

Figure 8:
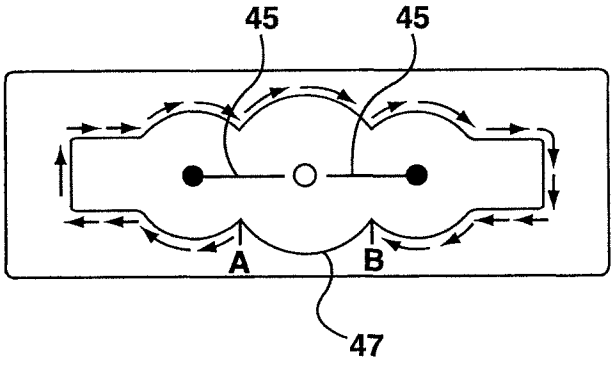
FIG. 8 is a top view of the apparatus of FIG. 4 during the performance of another block of FIG. 6.

Block 46 comprises sewing a first stitch substantially around the perimeter of the apparatus 10*a*. For example, the first stitch can be sewn in a clockwise direction from starting point A to end point B leaving the opening 47 (see FIG. 8). A double stitch can be used at the beginning of the stitch (e.g., by reversing the direction of the stitching after stitching about half an inch from the starting point A).

Figure 9:
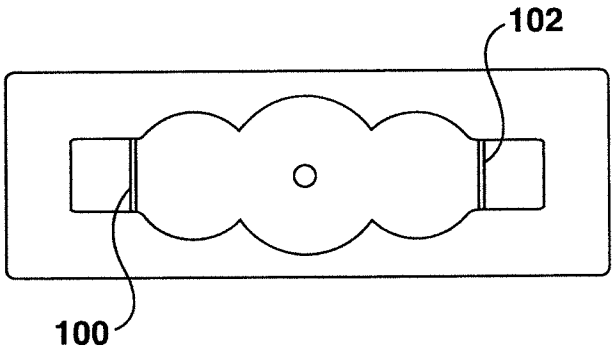
FIG. 9 is a top view of the apparatus of FIG. 4 during the performance of yet another block of FIG. 6.
Figure 10:
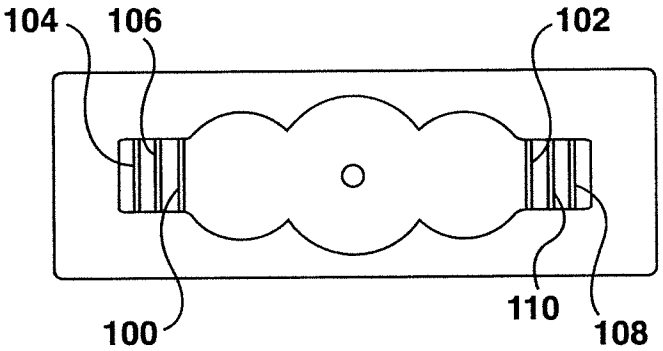
FIG. 10 is a top view of the apparatus of FIG. 4 during the performance of yet another block of FIG. 6.

Block 48 comprises sewing a stitch on each side of mid-portion 24 to separate the mid-portion 24 from the wings 26, 28. This defines an interior space within mid-portion 24 to receive a fill material (further details will be provided below). For example double stitches 100 and 102 can be sewn as illustrated in FIG. 9.

Block 50 comprises sewing four stitches 104, 106, 108 and 110. The stitches 104 and 106 form a first pair of stitches and the stitches 108 and 110 form a second pair of stitches. Each pair of stitches on the wings 26 and 28 is parallel to the stitches 100 and 102. The first pair of stitches 104 and 106 defines a region to create the first strap aperture 14*a*. The second pair of stitches 108 and 110 defines a region to create the strap aperture 16*a*.

Block 52 comprises sewing a circle to define a region to form the knot aperture 18*a*.

Block 54 comprises cutting the apparatus 10*a* from the fabric. For example, a pair of scissors can be used to cut substantially around the perimeter of the apparatus 10*a*.

Figure 11:
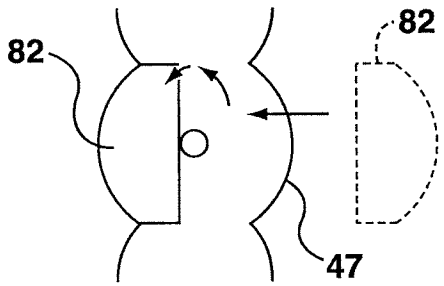
FIG. 11 is a top view of the apparatus of FIG. 4 during the performance of yet another block of FIG. 6.
Figure 12:
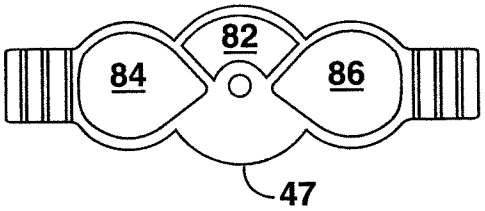
FIG. 12 is a top view of the apparatus of FIG. 4 during the performance of yet another block of FIG. 6.
Figure 13:
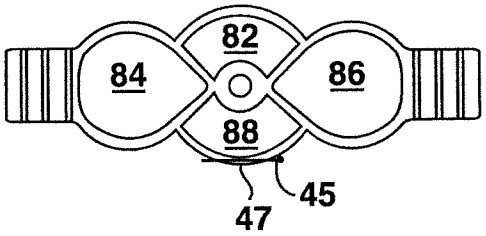
FIG. 13 is a top view of the apparatus of FIG. 4 during the performance of yet another block of FIG. 6.

Block 56 comprises inserting a filler material into the mid-portion 24. For example, a first piece 82 can be inserted into a region distal from an opening 47 (see FIG. 11), a second piece 84 and a third piece 86 can be inserted in each region between the knot aperture 18*a* and respective wings 26, 28 (see FIG. 12). A fourth piece 90 can be inserted into the region adjacent to the opening 47 and a pin 45 can be used to temporarily hold the seal the opening (see FIG. 13). The filler material can comprise fibre foam or any other compressible material including but not limited to wool batting, cotton Warm & Natural™, polyolefin Thinsulate™, and polyester fibrefill. Although four pieces were used in this embodiment, it is to be appreciated that any number of pieces can be inserted. By using a larger number of small pieces, each piece can be inserted more easily. In addition, the tolerances for the smaller pieces can be relatively larger making the smaller pieces easier to manufacture. However, by using a smaller number of larger pieces, the rigidity of the apparatus 10*a* is increased. By increasing the rigidity, the distribution of pressure is improved.

Figure 14:
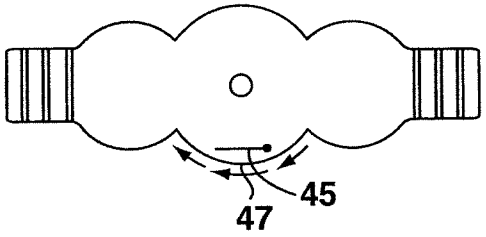
FIG. 14 is a top view of the apparatus of FIG. 4 during the performance of yet another block of FIG. 6.

Block 58 comprises sewing the opening 47 to seal the opening 47. In the present embodiment shown in FIG. 14, a double stitch can be sewn in across the opening 47 to increase the integrity of the seal. However, it is to be appreciated that any sealing means may be used. For example, the opening 47 can be sealed with staples or adhesives. In addition, other types of stitching can be used.

Block 60 comprises creating the knot aperture 18*a*. In the present embodiment, a hollow tube is created to form the knot aperture 18*a*. It is to be understood that this block can be omitted to leave a recess.

Block 62 comprises creating the first strap aperture 14*a* and the second strap aperture 16*a*. For example, a seam ripper can be used to cut a slit in between the stitches G and F sewn in Block 50.

Block 64 comprises trimming the apparatus 10*a*. For example, a pair of scissors can be used to trim the excess material from edges to eliminate fraying of the fabric. For example, the following edges can be trimmed: strap apertures 14*a*, 16*a*, knot aperture 18*a*, and the perimeter of the apparatus 10*a*.

Block 66 comprises sealing the seam. For example, Fray Check™ can be used to seal the edges of: the first strap aperture 14*a*, the second strap aperture 16*a*, the knot aperture 18*a*, and the perimeter of the apparatus 10*a*.

It is to be understood that the above blocks need not be performed in the order presented, some blocks can be merged into one, and some blocks can be omitted without deviating from the present invention. For example, Blocks 52 and 60 can be merged into one block. For another example, Blocks 50 and 62 can be merged into one block. As another example, Block 60 can be omitted if a divot rather than a hollow tube is desired.

Furthermore, it is to be understood that variations of the method shown in FIG. 6 are also contemplated. In the embodiment shown in FIG. 6, a sewing machine is used for sewing in Blocks 48, 50, 52 and 58. In other embodiments, an embroidery machine can be used for any or all of Blocks 48, 50, 52 and 58. It is to be appreciated that the embroidery machine can combine or merge two or more of the blocks to provide faster manufacturing of the apparatus 10*b* by reducing the number of blocks that must be individually carried out. For example, Blocks 48, 50 and 52 can be performed simultaneously by an embroidery machine and Block 58 can be performed subsequently by a sewing machine.

Figure 15:
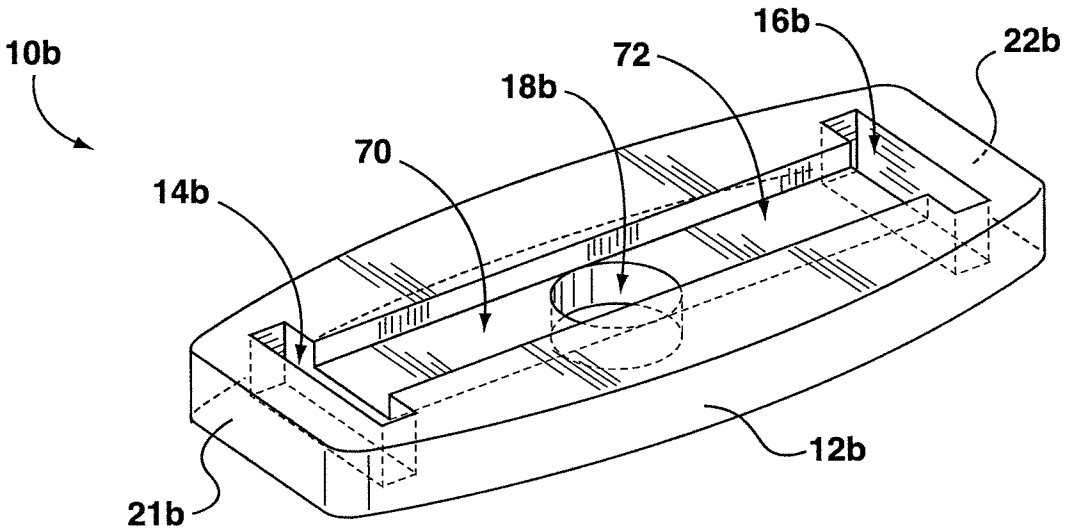
FIG. 15 is an isometric view of an apparatus according to yet another embodiment.
Figure 16:
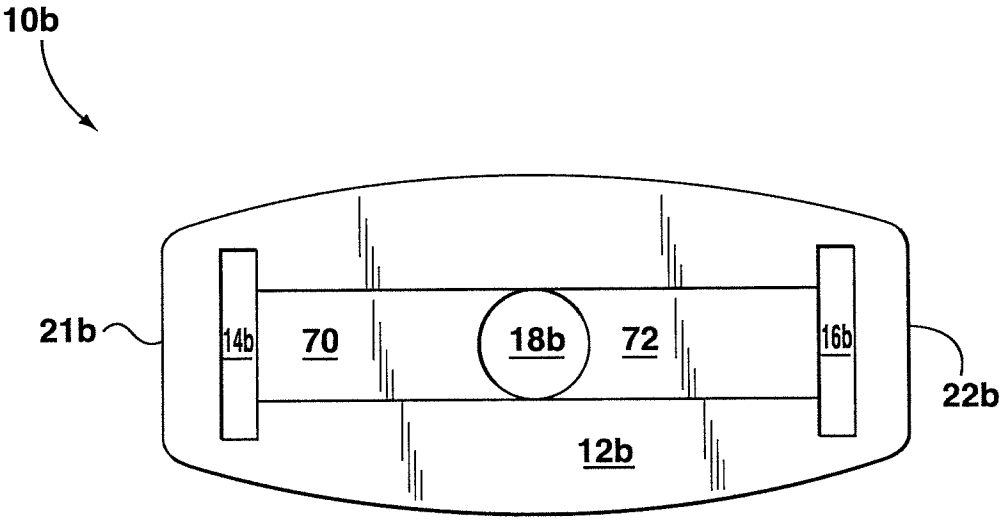
FIG. 16 is a top view of the embodiment shown in FIG. 15.

Referring to FIGS. 15 and 16, an alternative embodiment of the apparatus 10 is shown as apparatus 10*b*. Like reference numerals are used to designate similar structures of the apparatus 10*b* found in the above-described embodiments but with a suffix "b" appended thereto. The apparatus 10*b* comprises a substantially planar member 12*b* defining a first strap aperture 14*b*, a second strap aperture 16*b*, a knot aperture 18*b*, a first channel 70 and a second channel 72. The knot aperture 18*b* is disposed between the first strap aperture 14*b* and the second strap aperture 16*b*.

The first channel 70 is disposed between the first strap aperture 14*b* and the knot aperture 18*b* to receive and support a strap. In addition, the first channel 70 can also be configured to guide the strap over an area on a surface of the apparatus 10*b*. The second channel 72 is disposed between the second strap aperture 16*b* and the knot aperture 18*b* to receive and support a strap. In addition, the second channel 72 can also be configured to guide the strap over an area on a surface of the apparatus 10*b*. It is to be understood that the strap supported by the first channel 70 and the second channel 72 can be the same strap or different straps depending on the garment being worn.

It is to be understood that variations of the apparatus 10*b* are also contemplated. For example, in some embodiments, the first channel 70 and the second channel 72 can be combined to form a single channel extending between the first strap aperture 14*b* and the second strap aperture 16*b*. It is to be appreciated that the single channel would provide similar functionality to guide the at least one strap over an area of on the surface of the apparatus 10*b* when the strap is under tension.

In yet another variant, it is to be understood that the apparatus 10*b* can be modified to omit the first aperture 14*b* and the second aperture 16*b* such that the first channel 70 and the second channel 72 secures the strap over an area by guiding the strap within the first and second channels 70, 72. In yet another variant, a single channel alone can be used to secure the strap over the area as well as guide the strap.

Figure 17:
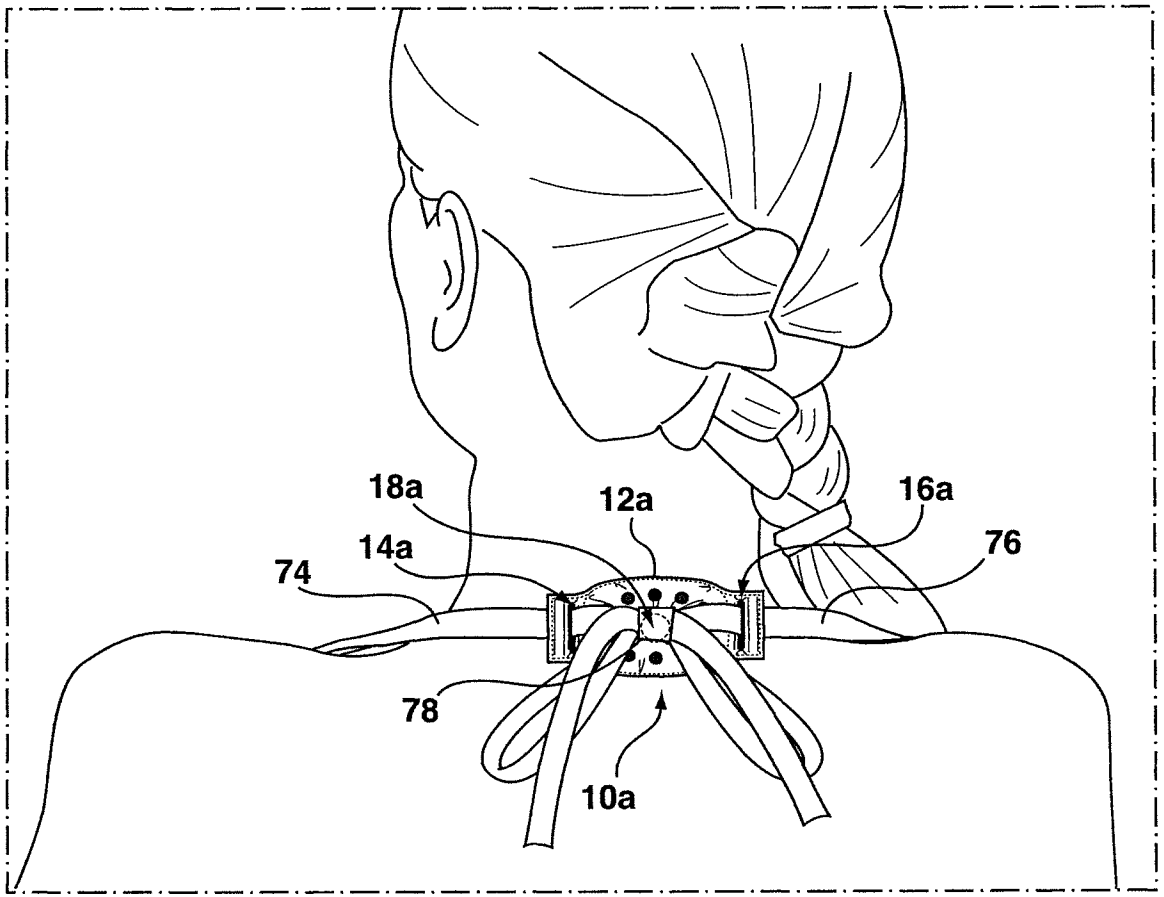
FIG. 17 is a view of the embodiment shown in FIG. 4 in use.
Figure 18:
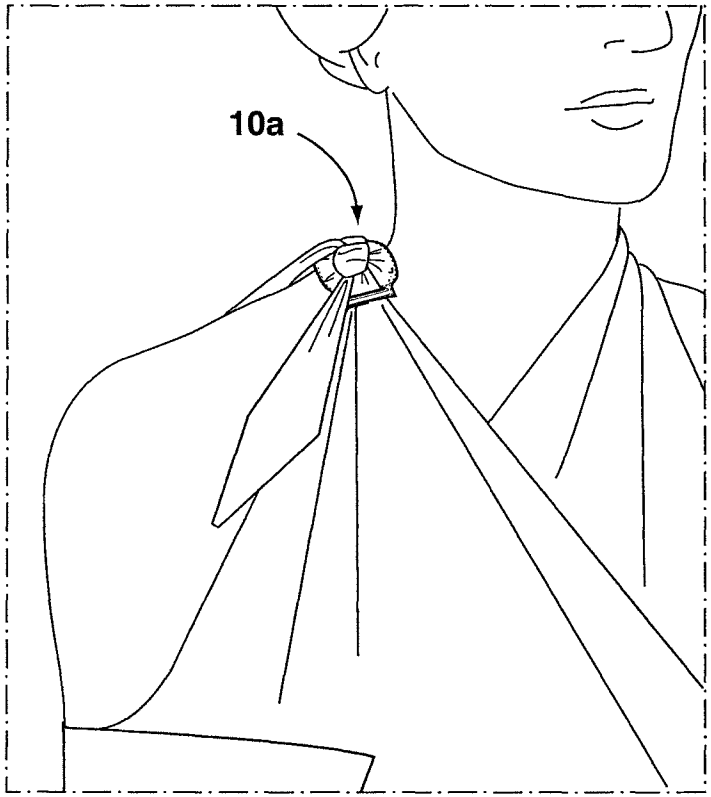
FIG. 18 is a view of the embodiment shown in FIG. 4 in another use.

Referring to FIGS. 17 and 18, the apparatus 10*a* is depicted in use, to support a knot fastened from straps 74, 76 of a halter top. The straps 74 and 76 of the halter top are threaded through the apertures 14*a*, 16*a*, respectively. After fastening the straps together to form a knot 78, the knot 78 is received by the knot aperture 18*a*. The knot 78 is positioned within the knot aperture 18 such that the knot 78 does not contact the wearer thereby relieving the wearer of discomfort that can be caused by the knot 78 and straps resting directly on the wearer's body. In other words, the pressure exerted on the wearer by the strap and knot 78 of halter top are received by a surface and distributed to reduce pressure applied against the wearer. Although FIGS. 17 and 18 use apparatus 10*a*, any of the other embodiments described in this description as well as other embodiments within the scope of this invention can also be used as an alternative to apparatus 10*a*.

Figure 19:
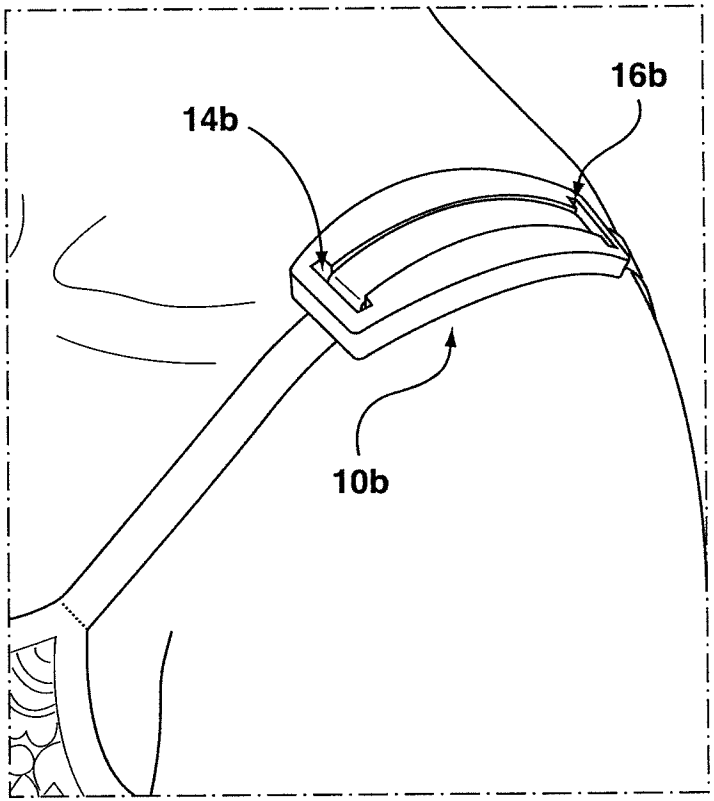
FIG. 19 is a view of the embodiment shown in FIG. 15 in use.

FIG. 19 illustrates a use of the apparatus 10*b* where a strap of a bra is supported by the apparatus 10*b*. It is to be understood that for this use, the apparatus 10*b* can be modified to omit the knot aperture 18*b* since this use does not involve supporting a knot.

Figure 20:
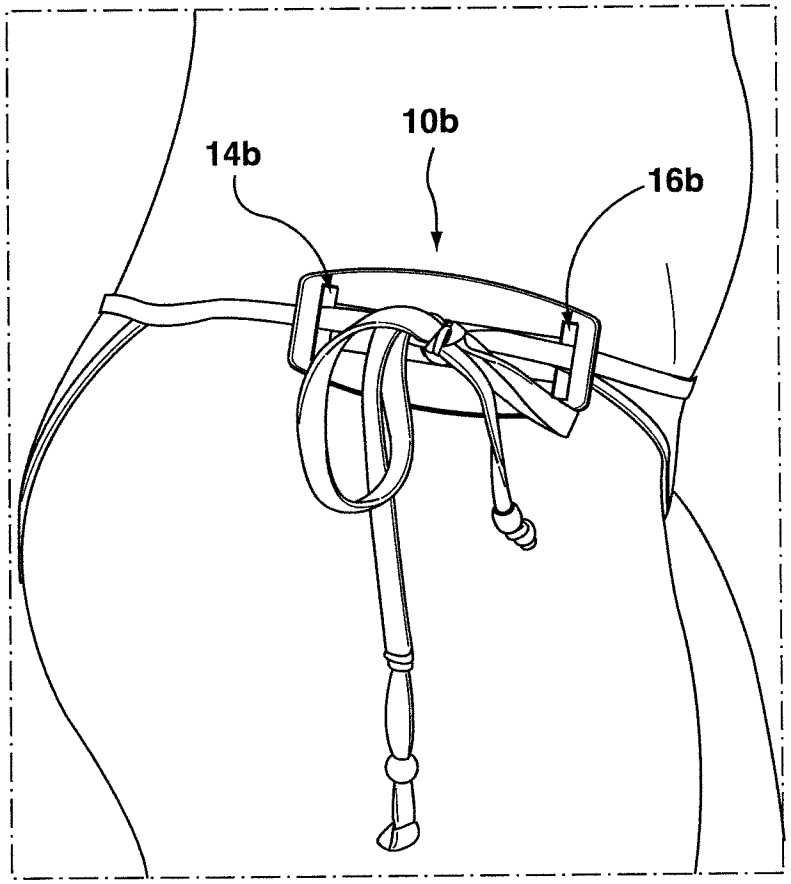
FIG. 20 is a view of the embodiment shown in FIG. 15 in another use.

FIG. 20 illustrates yet another use of apparatus 10*b* where a strap of a bikini bottom is supported by apparatus 10*b*.

Although FIGS. 19 and 20 use apparatus 10*b*, any of the other embodiments described in this description as well as other embodiments within the scope of this invention can also be used as an alternative to apparatus 10*b*.

Figure 21:
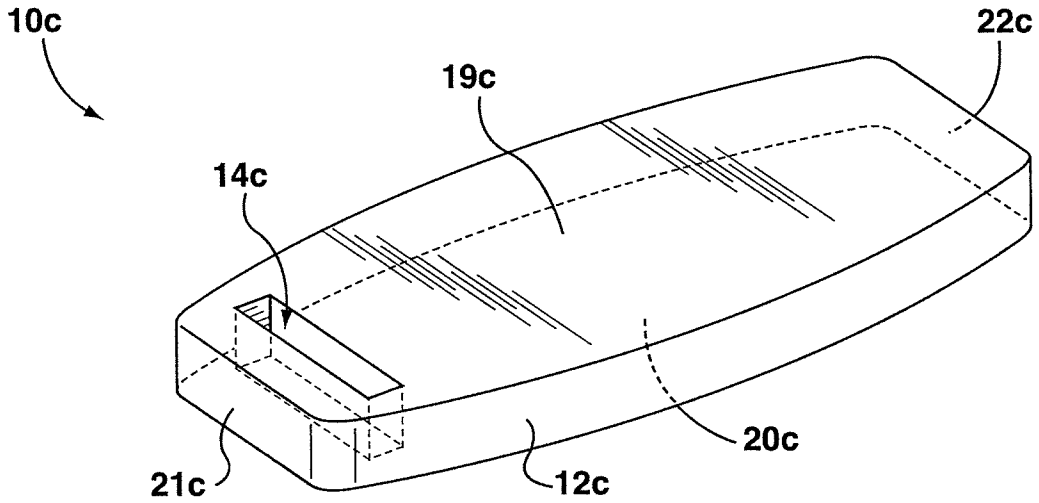
FIG. 21 is an isometric view of an apparatus according to yet another embodiment.

Referring to FIG. 21, another alternative embodiment is shown. Like reference numerals are used to designate similar structures found in the above-described embodiments but with a suffix "c" appended thereto. Apparatus 10*c* differs from apparatus 10 in that the second strap aperture 16 and the knot aperture 18 are omitted. The apparatus 10*c* includes a first surface 20*c*, a second surface 19*c*, and a securing mechanism. In the present embodiment, the securing mechanism includes a strap aperture 14*c*.

In the present embodiment, the aperture 14*c* defined by the substantially planar member 12*c* can be used for receiving or threading at least one strap therethrough, such that the at least one strap runs across the second surface 19*c*, and the pressure from the at least one strap is distributed across to the first surface 20*c*.

Figure 22:
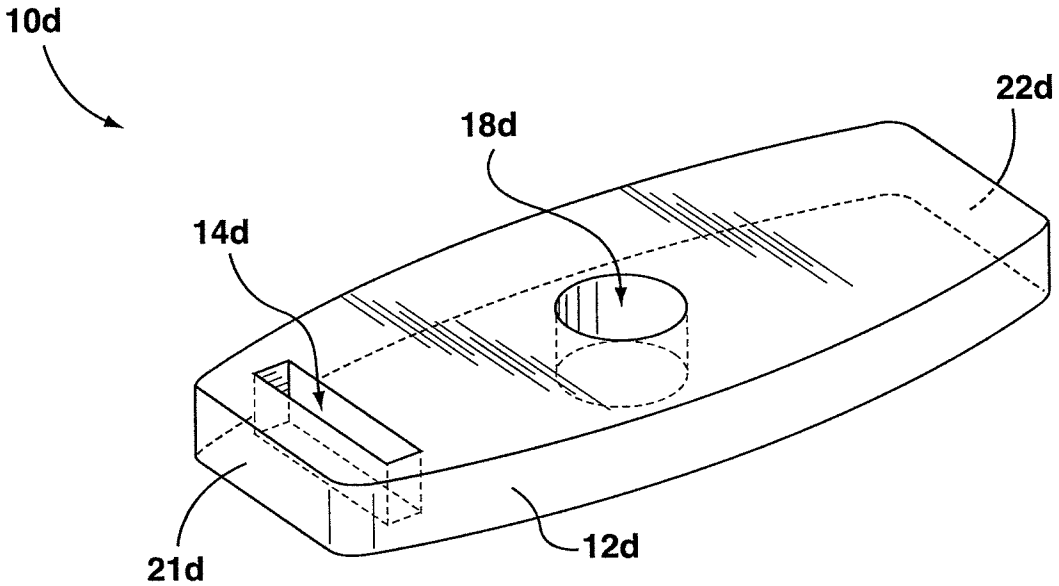
FIG. 22 is an isometric view of an apparatus according to yet another embodiment.

Referring to FIG. 22, yet another alternative embodiment is shown. Like reference numerals will be used to designate similar structures found in the above-described embodiments but with a suffix "d" appended thereto. Apparatus 10*d* differs from apparatus 10 in that the second strap aperture 16 is omitted.

It is to be understood that the apparatus 10*c* and 10*d* can be used, for example, when the wearer is not participating in physically demanding activities which may cause the apparatus 10*c* and 10*d* to dislodge from supporting a strap of the garment.

Figure 23:
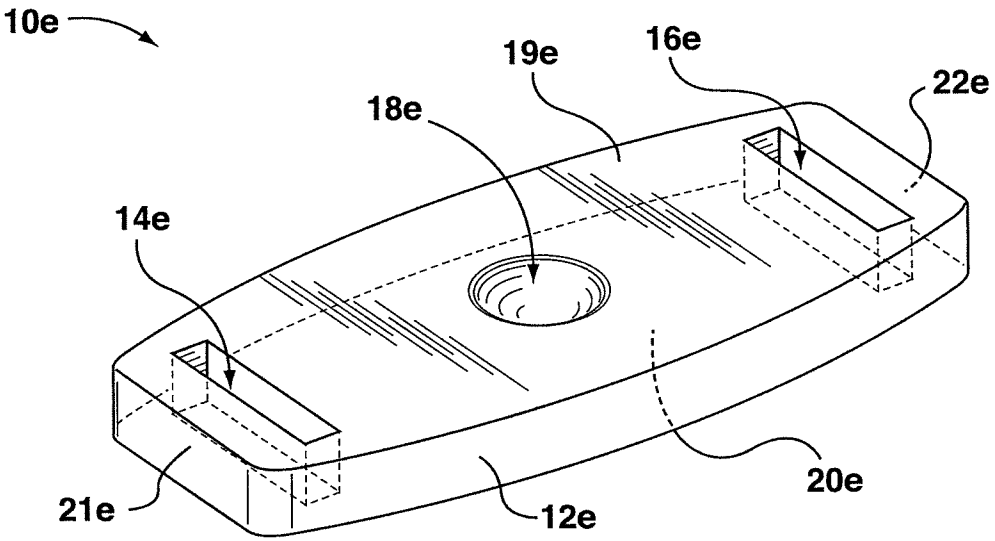
FIG. 23 is an isometric view of an apparatus according to another embodiment.

Referring to FIG. 23, another alternative embodiment of the apparatus 10 is shown generally at 10*e*. Like reference numerals will be used to designate similar structures of the apparatus 10, but with a suffix "e" appended thereto. The apparatus 10*e* includes a substantially planar member 12*e* having a securing mechanism. In the present embodiment, the securing mechanism includes a first strap aperture 14*e*, a second strap aperture 16*e* and a recess 18*e*. In addition, the apparatus 10*e* also includes a first surface 20*e*, a second surface 19*e*, and ends along the major axis truncated to form substantially straight edges 21*e* and 22*e*.

In the present embodiment, the recess 18*e* functions in a similar way to the knot aperture 18. The recess 18*e* is not particularly limited and can be any shape or size that can receive and position a knot of a strap under tension. In the present embodiment, the recess 18*e* is a divot. In addition to supporting the knot, the recess 18*e* can also be configured to guide the knot to a position above the recess 18*e*.

It is to be understood that variations of the apparatus 10 are also contemplated. For example it is to be understood that the apparatus 10*b* can be modified to omit the first strap aperture 14*b* and the second aperture 16*b* such that the recess 18*e* secures the strap over an area by receiving a knot and guiding the knot to a position over the recess 18*e* when the strap is under tension.

Persons skilled in the art will now appreciate that there are yet more alternative embodiments and modifications, and that the above embodiments and examples are only illustrations of one or more embodiments. For example, in the above illustrated examples, the wearer is a female human being, however, it is contemplated that the invention can also be used by a male human being. The wearer can also be animals such as dogs, cats, horses, etc.

What is claimed is:

1. An apparatus for distributing pressure from at least a first strap end portion and a second strap end portion knotted to one another, the apparatus comprising:

a first flexible sheet having a first surface, the first surface having a first area for resting against a wearer;

a second flexible sheet fastened to the first flexible sheet to form an envelope, the envelope being stuffed with a filler material;

the second flexible sheet having a second surface opposite the first surface, the second surface for supporting the strap end portions over a second area, the second area being a portion of a total area of the second surface that comes into contact with the strap end portions, the first area being larger than the second area such that a first pressure applied by the first surface on the wearer is less than a second pressure applied by the strap end portions on the second surface, the filler material being compressible in response to the second pressure; and a securing mechanism for securing the strap end portions over the second area, the securing mechanism having a first strap aperture configured to receive the first strap end portion therethrough;

a second strap aperture configured to receive the second strap end portion therethrough; and a knot aperture extending through the first and second areas, the knot aperture disposed between the first and second strap apertures and on a substantially straight line extending from a center of the first strap aperture to a center of the second strap aperture, the knot aperture for receiving the knot therein to position the knot within the knot aperture.

2. The apparatus of claim 1, wherein the knot comprises a fastening between the first strap end portion and the second strap end portion.

3. A method for distributing pressure from at least a first strap end portion and a second strap end portion knotted to one another, the method comprising:

resting against a wearer a first area of a first surface of a first flexible sheet;

supporting the strap end portions over a second area of a second surface of a second flexible sheet, the second flexible sheet fastened to the first flexible sheet to form an envelope, the envelope being stuffed with a filler material, the second surface opposite the first surface, the second area being a portion of a total area of the second surface that comes into contact with the strap end portions, and the first area being larger than the second area such that a first pressure applied by the first surface on the wearer is less than a second pressure applied by the strap end portions on the second surface, the filler material being compressible in response to the second pressure; and securing the strap end portions over the second area, wherein the securing comprises passing the first strap end portion through a first strap aperture;

passing the second strap end portion through a second strap aperture;

positioning the knot within a knot aperture extending through the first and second areas, the knot aperture disposed between the first and second strap apertures and on a substantially straight line extending from a center of the first strap aperture to a center of the second strap aperture.

* * * * *